US006979023B2

(12) United States Patent
Mikasa et al.

(10) Patent No.: US 6,979,023 B2
(45) Date of Patent: Dec. 27, 2005

(54) DIE CAST SUB-FRAME

(75) Inventors: Tetsuo Mikasa, Wako (JP); Tsutomu Ogawa, Wako (JP); Nobuo Kubo, Wako (JP); Fumiaki Fukuchi, Wako (JP); Haruyuki Iwasaki, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/984,780

(22) Filed: Oct. 31, 2001

(65) Prior Publication Data

US 2002/0050706 A1 May 2, 2002

(30) Foreign Application Priority Data

Nov. 1, 2000 (JP) ..... 2000-334625
Nov. 1, 2000 (JP) ..... 2000-334633

(51) Int. Cl.[7] ..... B62D 21/00; B62D 21/11

(52) U.S. Cl. ..... 280/781; 280/124.109; 180/311; 164/120; 164/320

(58) Field of Search ..... 280/781, 785, 280/788, 124.109, 124.134; 180/311; 164/120, 164/319, 320

(56) References Cited

U.S. PATENT DOCUMENTS 4,453,740 A * 6/1984 von der Ohe et al. ..... 280/781
4,497,359 A * 2/1985 Suzuki et al. ..... 164/120
4,501,436 A * 2/1985 Ishida ..... 280/124.108
4,633,931 A * 1/1987 Yamaguchi et al. ..... 164/110
4,671,531 A * 6/1987 Sautter et al. ..... 280/124.109
4,700,959 A * 10/1987 Lars ..... 280/79.11
4,989,665 A * 2/1991 Yamagiwa et al. ..... 164/363
5,031,739 A * 7/1991 Flotow et al. ..... 192/13 R
5,240,279 A * 8/1993 Kunert ..... 280/86.753
5,560,651 A * 10/1996 Kami et al. ..... 208/788
5,593,001 A * 1/1997 Takano et al. ..... 180/312
5,611,569 A * 3/1997 Sekiguchi et al. ..... 280/788
6,068,330 A * 5/2000 Kasuga et al. ..... 296/187.09
6,109,654 A * 8/2000 Yamamoto et al. ..... 280/784
6,193,273 B1 * 2/2001 Novak et al. ..... 280/781
6,279,938 B1 * 8/2001 Koetter et al. ..... 280/438.1
6,354,627 B1 * 3/2002 Kasuga ..... 280/781
6,428,046 B1 * 8/2002 Kocer et al. ..... 280/781
6,679,545 B1 * 1/2004 Balzer et al. ..... 296/193.09

FOREIGN PATENT DOCUMENTS

DE 19922800 A1 * 11/1999 ..... B62D 21/02
FR 2615458 A1 * 11/1988 ..... B60K 5/00
JP 4-232183 8/1992
JP 8192642 * 7/1996
JP 11286291 * 10/1999
JP 2001-232454 * 8/2001

* cited by examiner

*Primary Examiner*—Paul N. Dickson
*Assistant Examiner*—George D. Spisich
(74) *Attorney, Agent, or Firm*—Arent Fox PLLC

(57) ABSTRACT

A pound or number sign shaped (#-shaped) die cast sub-frame includes first and second horizontal members and first and second vertical members. The sub-frame has four arm mounting portions provided at four corners thereof, respectively. The arm mounting portion is a die cast part obtained near a communication portion of a runner formed in a die casting machine. Generally triangular bulged portions are formed at junction portions where the first horizontal member meets the first and second vertical members. Each junction portion has increased width. The junction portion is a die cast obtained within a cavity of increased width of the die casting machine. The bulged portion is pierced to provide a hole. The bulged portion having the hole formed therein is to be mounted to a small vehicle component.

1 Claim, 9 Drawing Sheets

FIG. 7A "PRIOR ART"

DIE CAST SUB-FRAME

FIELD OF THE INVENTION

The present invention relates to an improvement in a die cast sub-frame for a vehicle.

BACKGROUND OF THE INVENTION

Vehicular sub-frames are well known in the art. An example of such sub-frames is disclosed in Japanese Patent Laid-Open Publication No. HEI 4-232183 entitled "SUSPENSION CROSS MEMBER FOR VEHICLE". The disclosed suspension cross member is used to mount a generally A-shaped suspension arm to a front frame of a vehicle body therethrough. The cross member has an arm securing portion extending therefrom. The arm securing portion has a reinforcing member provided thereon. The suspension arm is supported by the reinforcing member.

The suspension arm is made from light metals such as aluminum alloy for reduction in weight. Since the arm securing portion itself provides insufficient strength, the reinforcing member serves to reinforce the arm securing portion of the cross member.

These types of vehicular sub-frames should provide strengths sufficient to mount such vehicle components as suspensions to vehicle bodies. It is preferred for these sub-frames to be partly increased in strength because they are undesirably increased in weight if strengthened throughout.

For the cross member as disclosed in the aforementioned publication, the separate reinforcing member of steel is provided to achieve the increased strength of the arm securing portion of the cross member. This increases the number of parts of the cross member. The cross member having such an additional reinforcing member is manufactured at a higher cost.

Moreover, a joining process such as welding or casting would be necessarily performed if the reinforcing member needs to be firmly joined to the A-shaped suspension arm. Such a joining process is, however, undesirably costly to perform.

FIG. 8 hereof shows in plan a conventional sub-frame 101 mounted to a vehicle body (not shown). The sub-frame 101 includes horizontal members 121, 121 and vertical members 122, 122. Similarly to the cross member as discussed above, the sub-frame 101 is used in mounting to the vehicle body a vehicle component such as a suspension. Additional projecting portions 102, 102 are provided in place on the sub-frame 101. The projecting portions 102, 102 are to be mounted to an exhaust pipe 103 through a band 104 and a bolt 105. The sub-frame is usually produced by subjecting blanks to press working and then welding them together. However, the press working and the subsequent welding are not suitable for producing the sub-frame with improved efficiency. Moreover, the press working and welding is undesirably costly to perform. To address these problems, casting is often used in producing the sub-frames. The use of the casting enables the sub-frames to be produced in large amounts.

With respect to FIG. 9 hereof, a lost foam pattern made from expandable resin is shown as being buried or embedded in sand 115. The pattern has formed therein a gate 111, runners 112, 112 communicating with the gate 111, a cavity 113 communicating with the runner 112, and gas vents 114, 114 communicating with the cavity 113. Molten metal 116 is poured into the cavity 113 through the gate 111 and the runners 112, 112, after which the pattern is melted and vaporized by the heat of the molten metal to provide a desired casting for use as a sub-frame. Rather than the pattern, metal molds are more preferably used to facilitate producing the sub-frame in large amounts. Because the casting does not involve the press working and welding as discussed above, the sub-frame can be produced with improved efficiency.

Referring to FIG. 10 hereof, there is shown the pound sign-shaped or number sign-shaped (hereinafter #-shaped) cavity 113 having recessed portions 117, 117 communicating therewith. The four runners 112 extend from the gate 111 to the cavity 113. If poured into a metal mold having the cavity 113 thus arranged, the molten metal flows slowly into the recessed portions 117, 117. The molten metal within the recessed portions 117, 117 is then cast into the projecting portions to be mounted to vehicular components.

It is desirable to use die casting rather than the above-mentioned casting so as to ensure that the sub-frame provides increased strength. Die casting machines are designed such that molten metal is forced into cavities formed in the die casting machines at a high pressure and speed to thereby provide a die casting of dense cast structure. Use of the die casting is advantageous because the resultant die cast sub-frames are lightweight and thin.

In producing the #-shaped sub-frame using a die casting machine having formed therein the cavity 113 as shown in FIG. 10, the molten metal flows at a very high speed within the cavity. Thus, misrun could be undesirably produced throughout the resultant die cast sub-frame. In addition, the molten metal would cause unwanted eddies or vortexes when flowing into the recessed portions 117, 117. The die casting is therefore less frequently used for producing the sub-frame.

SUMMARY OF THE INVENTION

An object of the present invention is to provide a partly strengthened sub-frame which can be produced without requiring any additional part.

A further object of the present invention is to provide a sub-frame produced by a die casting machine having formed therein a cavity free from the recessed portions.

According to a first aspect of the present invention, there is provided a die cast sub-frame for use in mounting a vehicle component to a vehicle body, the sub-frame being produced by a die casting machine having formed therein a gate, runners communicating with the gate, and a cavity communicating with a communication portion of the runner, the sub-frame comprising: a body portion; and mounting portions to be attached to the vehicle component, the mounting portions being provided on the body portion; the mounting portions each being positioned in correspondence to the communication portion.

Molten metal is forced into a cavity of the die casting machine under a high pressure. Upon flowing into the cavity, the molten metal starts to solidify. With the cavity filled with the molten metal, molten metal within the runners are under a high pressure, whereby the closest part of the molten metal to the communication portion is intensively pressured. This means that the molten metal positioned proximate the communication portion solidifies into the mounting portion having dense cast structure. This allows the mounting portion to have increased strength. The vehicle component is mounted to the mounting portion of increased strength.

Accordingly, it becomes possible to strengthen any desired or selected portion of the sub-frame without requiring separate members. Because there is no need for these separate members, the sub-frame can be manufactured at a low cost.

In a preferred form of the present invention, the vehicle component is the suspension.

According to a second aspect of the present invention, there is provided a die cast sub-frame for use in mounting a vehicle component to a vehicle body, comprising: first and second horizontal members extending laterally of the vehicle body in substantially parallel to each other; first and second vertical members extending longitudinally of the vehicle body in substantially parallel to each other, the first and second vertical members being disposed between and joined to the first and second horizontal members; and bulged portions positioned at junction portions where the first and second vertical members are joined to the first and second horizontal members, the bulged portions lying in a plane defined by the first and second horizontal members and the first and second vertical members.

The junction portions where the horizontal members meet the vertical members are positioned in correspondence to a portion of increased width of a cavity of a die casting machine. The portion of increased width has its enlarged sectional area. Therefore, molten metal to be die cast can flow through such a portion with improved fluidity. Additionally, the die cast sub-frame has no projecting portions as shown in FIG. 8. In other words, there is no need for the recessed portions as shown in FIG. 10. Absence of such recessed portions allows the molten metal to flow with improved fluidity within the cavity. Therefore, the molten metal can be die cast to thereby provide the sub-frame having no misrun throughout.

The die casting provides improved productivity of the sub-frame. The sub-frame produced by die casting molten light metals provides reduced weight and increased strength.

In a preferred form of the present invention, the bulged portion is mounted to a small vehicle component.

In a further preferred form of the present invention, the small vehicle component is an exhaust pipe.

In a still further preferred form of the present invention, the vehicle component is a suspension.

BRIEF DESCRIPTION OF THE DRAWINGS

Certain preferred embodiments of the present invention will be described in detail, by way of example only, with reference to the accompanying drawings, in which:

FIG. 7A illustrates part of a conventional rear sub-frame and FIG. 7B illustrates part of a rear sub-frame according to the present invention;

DETAILED DESCRIPTION OF THE PREFERRED EMBODIMENTS

Figure 1:
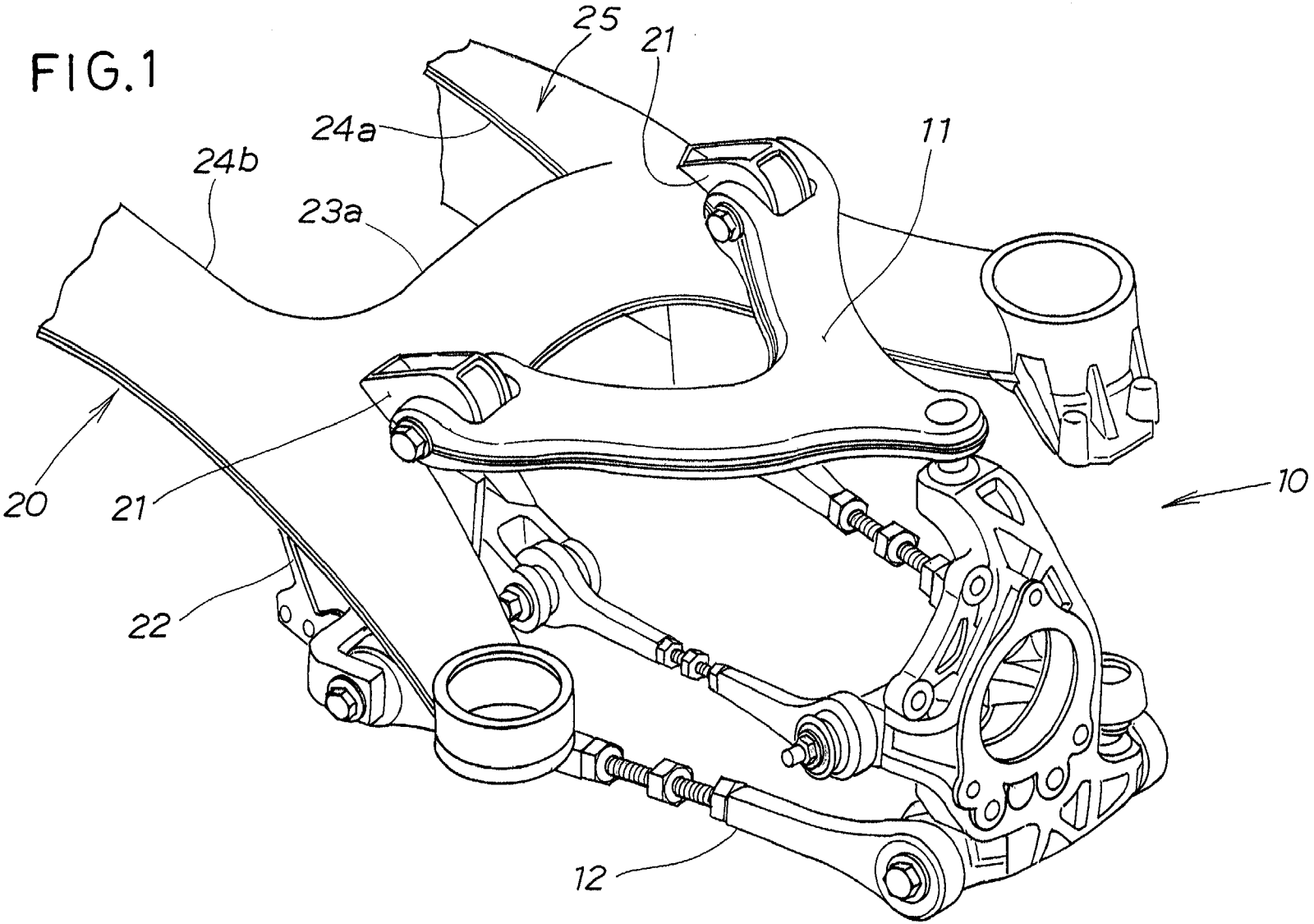
FIG. 1 is a fragmentary perspective view of a rear sub-frame according to the present invention.

Referring to FIG. 1, a rear sub-frame for a vehicle is shown generally designated 20. The sub-frame 20 includes a body portion 25 having arm mounting portions 21, 22 provided thereon. The arm mounting portions 21, 22 are attached to upper and lower arms 11, 12 of a suspension 10. The sub-frame 20 is mounted to a vehicle body (not shown). As can be seen from this figure, the suspension 10 is mounted to the vehicle body via the rear sub-frame 20.

The body portion 25 includes first and second vertical members 23*a*, 23*b* (only one shown) extending longitudinally or in a front-and-rear direction of the vehicle body, and first and second horizontal members 24*a*, 24*b* extending laterally or transversely of the vehicle body. The first and second vertical members 23*a*, 23*b* are disposed in substantially parallel to each other (see FIG. 4). The first and second horizontal members 24*a*, 24*b* are also disposed in substantially parallel to each other (see FIG. 4). The first and second vertical members 23*a*, 23*b* are disposed between and joined to the first and second horizontal members 24*a*, 24*b*. The body portion 25 has the arm mounting portions 21, 22 provided thereon. The sub-frame 20 is of generally #-shaped configuration.

In addition to the generally #-shaped configuration, the sub-frame 20 may be of H-shaped, I-shaped or other various configurations to serve as a crossmember disposed transversely of the vehicle body.

Figure 2:
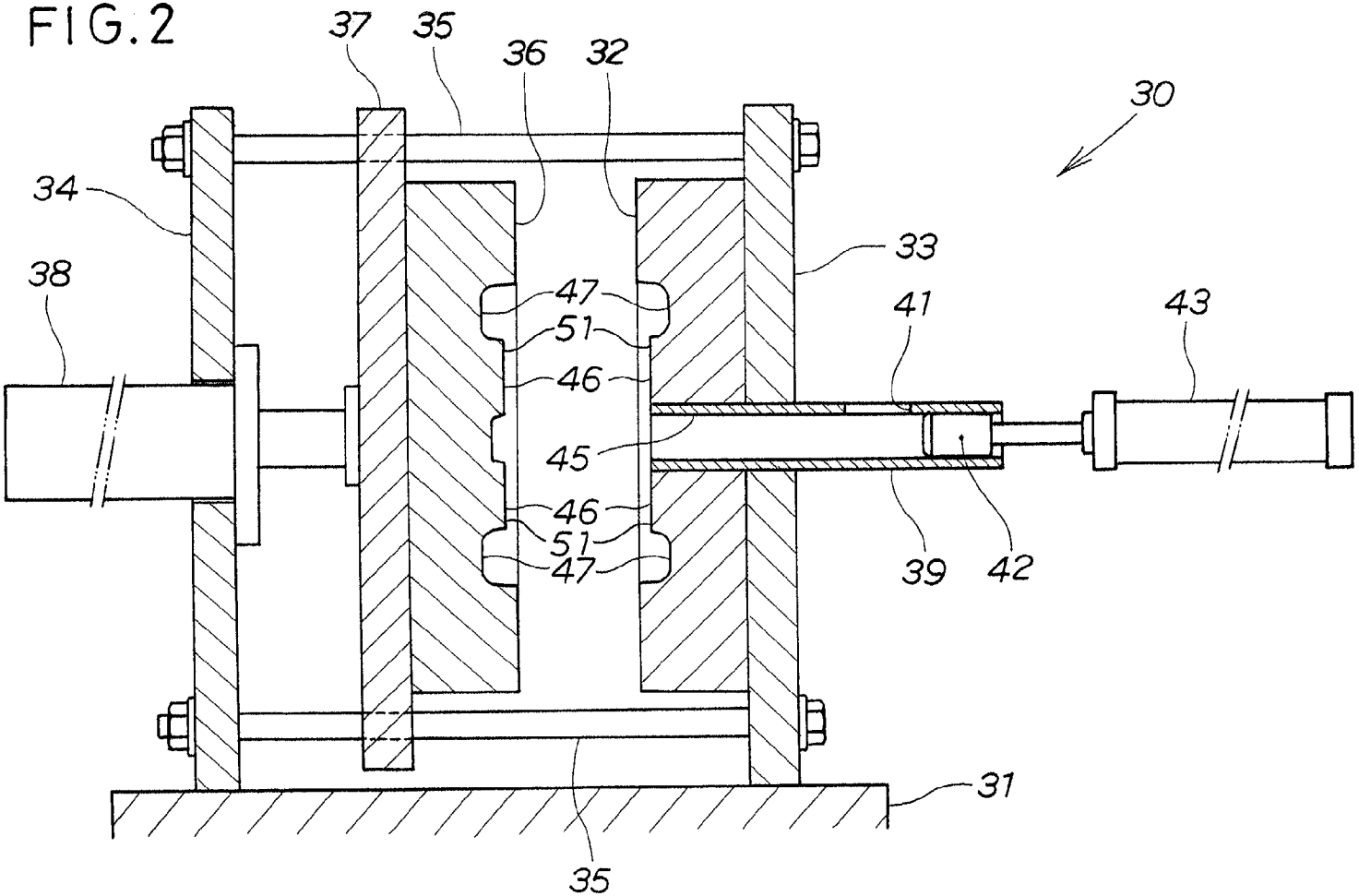
FIG. 2 illustrates a die casting machine for producing the rear sub-frame of FIG. 1.

As shown in FIG. 2, a die casting machine 30 includes a base 31, first and second stationary platens 33, 34, tie bars 35, 35, a moving platen 37, a die clamping cylinder 38, a shot sleeve 39, a plunger 42, and a cylinder 43. The first and second stationary platens 33, 34 are disposed in opposed relation to each other. The tie bars 35, 35 extend between the first and second stationary platens 33, 34. The first platen 33 has a stationary die 32 fixed thereto. The moving platen 37 has a moving die 36 fixed thereto. The moving platen 37 is movable along the tie bars 35, 35. The die clamping cylinder 38 extends through the second platen 34. In operation, the cylinder 38 clamps the moving die 36 against the stationary die 32. The sleeve 39 extends through the stationary platen 33 and the stationary die 32. Formed in the sleeve 39 is a hole 41 into which molten metal is to be poured. The cylinder 43 is arranged to force the plunger 42 through the sleeve 39.

The sleeve 39 has a gate 45 provided at an end thereof. When clamped against each other under a sufficient force, the moving die 36 and the stationary die 32 jointly define plural runners 46, 46 and a cavity 47. The runner 46 has a communication portion 51 communicating with the cavity 47.

Figure 3B:
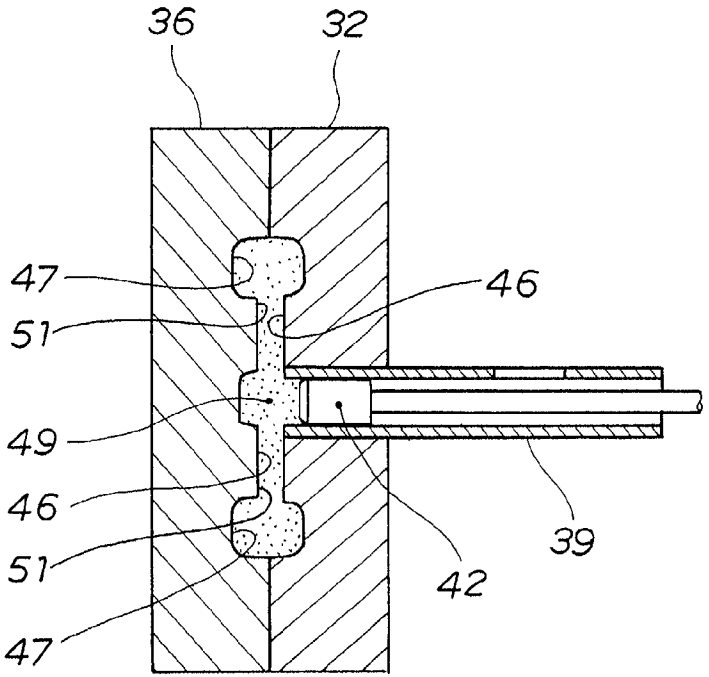
FIG. 3A illustrates molten metal poured into a hole formed in the die casting machine and FIG. 3B illustrates the molten metal forced into a cavity formed in the die casting machine.
Figure 3A:
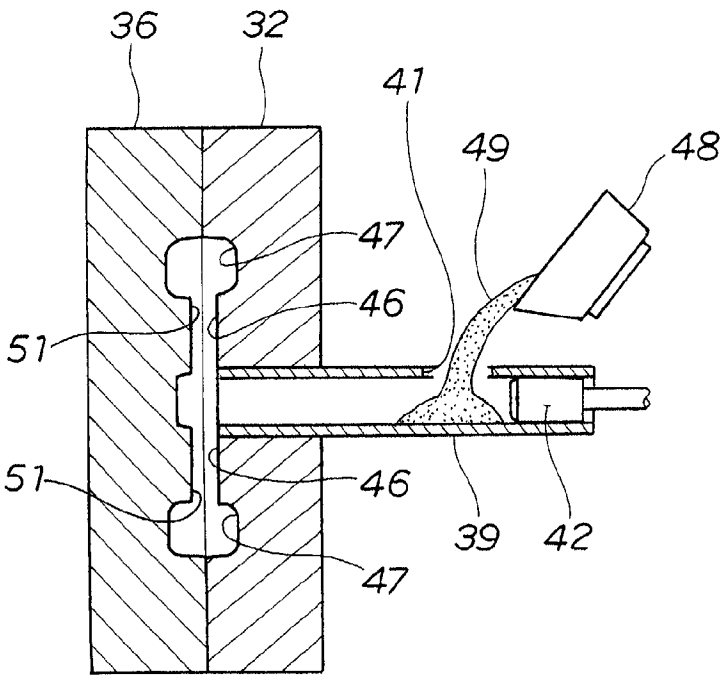

Reference is made to FIG. 3A and FIG. 3B. A predetermined amount of molten aluminum alloy 49 is poured from a downwardly inclined ladle 48 through the hole 41 into the sleeve 39, as shown in FIG. 3A.

When the plunger 42 is advanced at a high speed within the sleeve 39, as shown in FIG. 3B, the aluminum alloy 49 is forced to flow through the runners 46 into the cavity 47. The gate 45, the runners 46 and the cavity 47 are then filled with the molten aluminum alloy 49, whereupon the molten aluminum alloy within the cavity 47 starts to solidify. More specifically, the solidification first occurs at the remotest part of the aluminum alloy from the communication portion 51. The closest part of the aluminum alloy to the communication portion 51 last solidifies.

By the time the plunger 42 moves to the most advanced position, most of the molten aluminum alloy within the cavity 47 solidifies. Conversely, the nearest part of the aluminum alloy to the communication portion 51 within the cavity 47 does not yet solidify. At this time, the plunger 42 applies a pressure intensively to the nearest part of the aluminum alloy to the communication portion 51. Such a part is thus brought to the most compressed state. The thus most compressed part of the aluminum alloy eventually solidifies into a die cast part of dense cast structure. Such a die cast part has an increased strength. It is to be understood that the die casting has a larger strength than castings produced using sand molds or metal molds.

Figure 4:
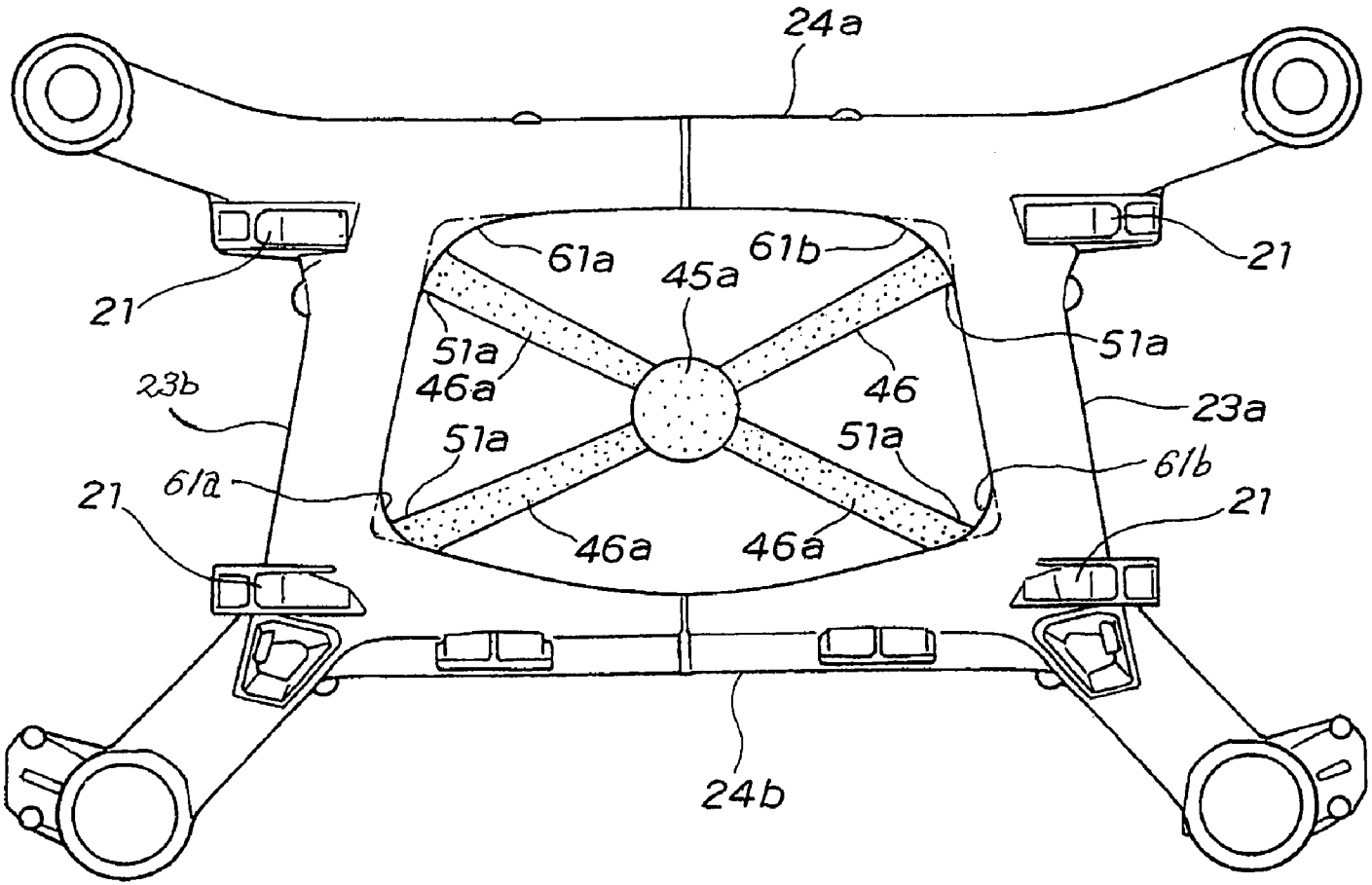
FIG. 4 illustrates a die casting produced by the die casting machine of FIG. 3.

Turning to FIG. 4, there is shown a generally #-shaped die casting produced using the die casting machine as discussed in relation to FIG. 3A and FIG. 3B. The #-shaped die casting as shown in this figure has been previously subjected to machining operation.

The die casting has the first and second horizontal members 24*a*, 24*b* and the first and second vertical members 23*a*, 23*b*. The die casting further includes a first die cast part 45*a* and four second die cast parts 46*a*. Each second die cast part 46*a* extends from the first die cast part 45*a* to the arm mounting portion 21. The first die cast part 45*a* is positioned in correspondence to the gate 45, i.e., the former is obtained within the gate 45 while the second die cast part 46*a* is positioned in correspondence to the runner 46, i.e., the former is obtained within the runner 46. Each arm mounting portion 21 is positioned in correspondence to a die cast part 51*a* of the second die cast part 46*a*. The die cast part 51*a* is obtained at the communication portion 51. It will be appreciated that any die cast part obtained near the communication portion 51 has dense cast structure and hence provides the most increased strength. It therefore becomes possible to increase the strength of the arm mounting portion 21.

The first die cast part 45*a* and the second die cast parts 46*a* are cut off thereafter.

The die casting having the die cast parts 45*a*, 46*a* thus removed is machined into the desired sub-frame 20 as shown in FIG. 1. The sub-frame 20 is made from aluminum alloy to thereby provide reduced weight. The sub-frame 20 can thus be produced without requiring an additional member of different metal as disclosed in the aforementioned publication. It is no longer costly to manufacture the sub-frame 20.

Figure 5:
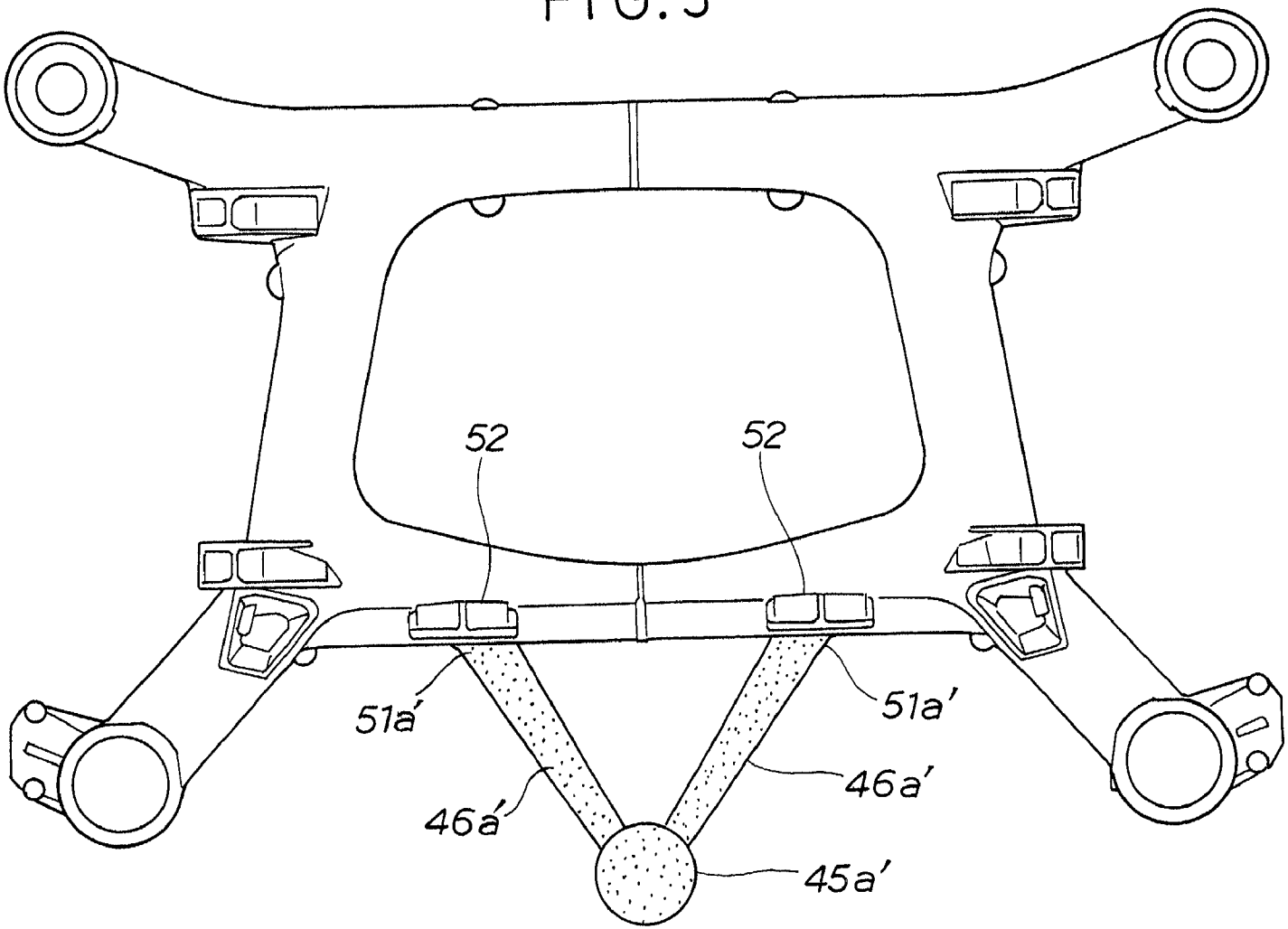
FIG. 5 illustrates a first modified die casting according to the present invention.
Figure 6:
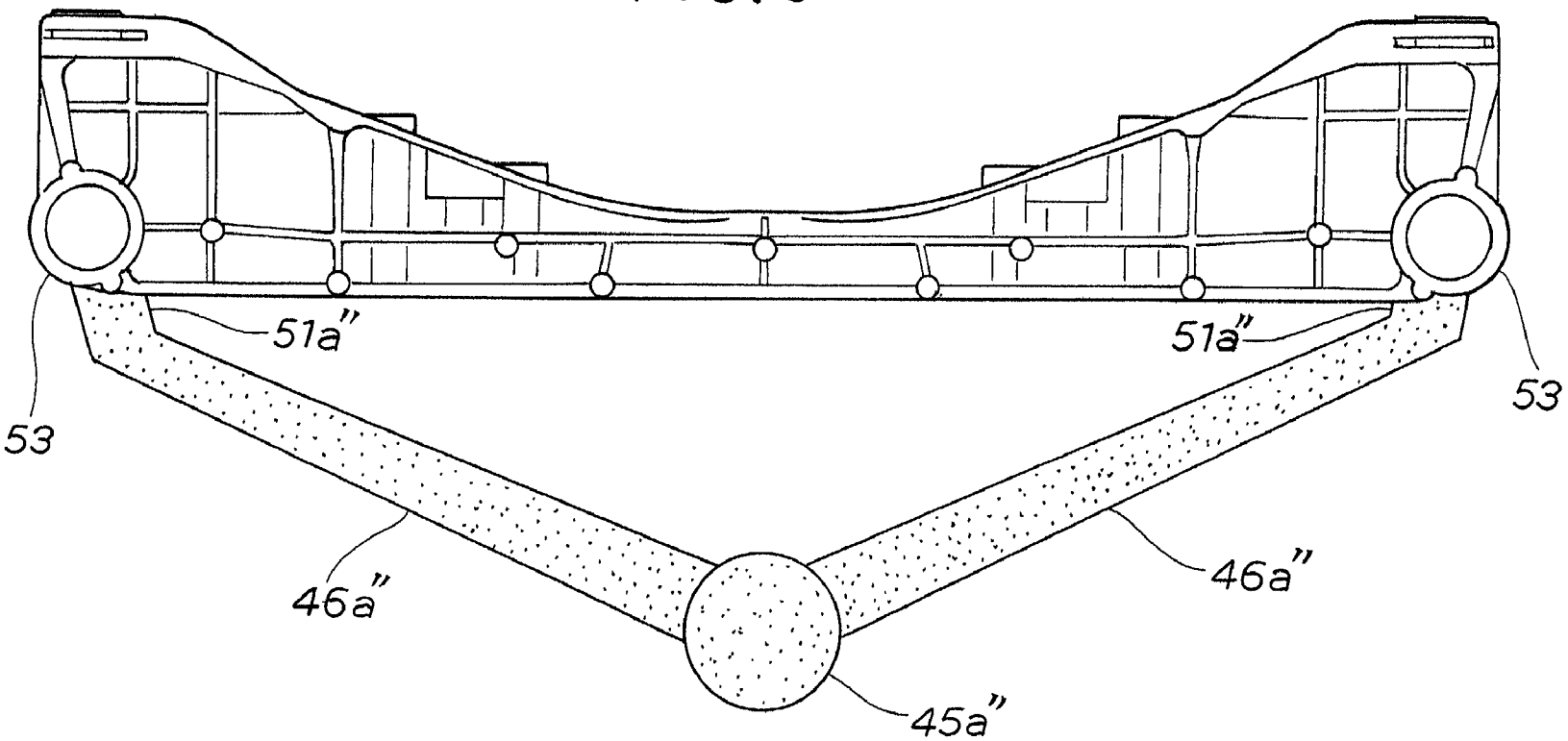
FIG. 6 illustrates a second modified die casting according to the present invention.

Shown in FIG. 5 and FIG. 6 are first and second modified die castings produced in the manner as discussed in relation to FIG. 3A and FIG. 3B. Elements of these two die castings in common with those discussed with respect to FIG. 1 through FIG. 4 are not separately described and are identically numbered with the addition of apostrophes for purposes of distinction. The die casting as shown in FIG. 5 has differential mounting portions 52, 52 provided thereon. The differential mounting portions 52, 52 are positioned in correspondence to die cast parts 51*a*', 51*a*' of second die cast parts 46*a*', 46*a*'. The die casting is formed into a #-shaped sub-frame in the same manner as the die casing of FIG. 4. This arrangement provides increased strength of the differential mounting portion 52.

The die casting as shown in FIG. 6 has suspension mounting portions 53, 53 provided at opposite ends thereof. The suspension mounting portions 53, 53 are positioned in correspondence to die cast parts 51*a*", 51*a*" of second die cast parts 46*a*", 46*a*". The die casting is formed into an I-shaped sub-frame in the same manner as the die casing of FIG. 4. This arrangement provides increased strength of the suspension mounting portion 53.

The term "vehicle component" as used herein is intended to include not only the suspension and the differential but also an engine mounting and a wide variety of suspension-related components such as a spring.

The molten metal to be die cast may be magnesium alloy, Cu—Al alloys, steel, or other material suitable for the die casting. The aluminum alloy or magnesium alloy is preferably used for reducing the weight of the resultant sub-frame.

Figure 7B:
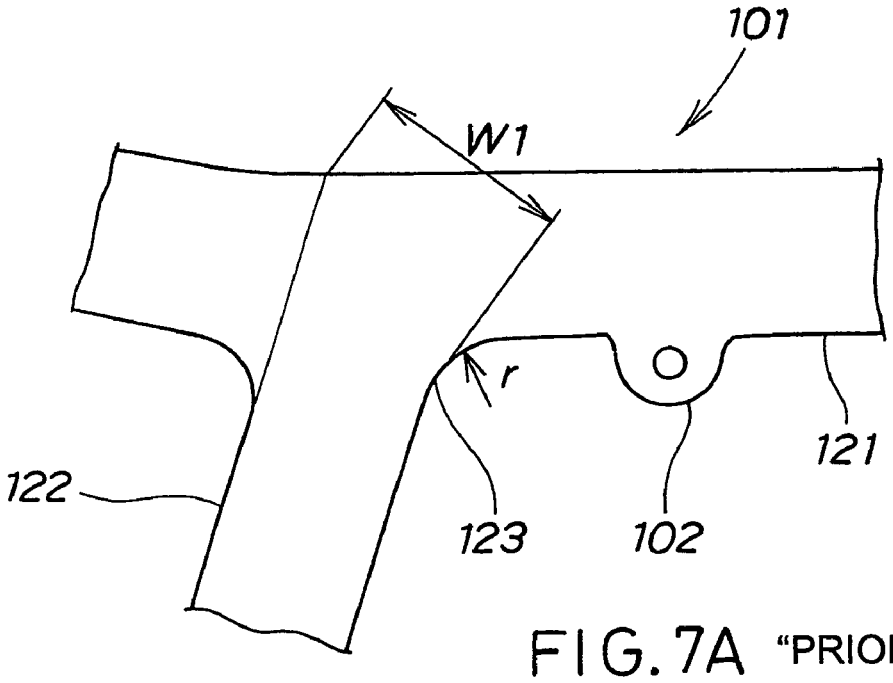
Figure 7B:
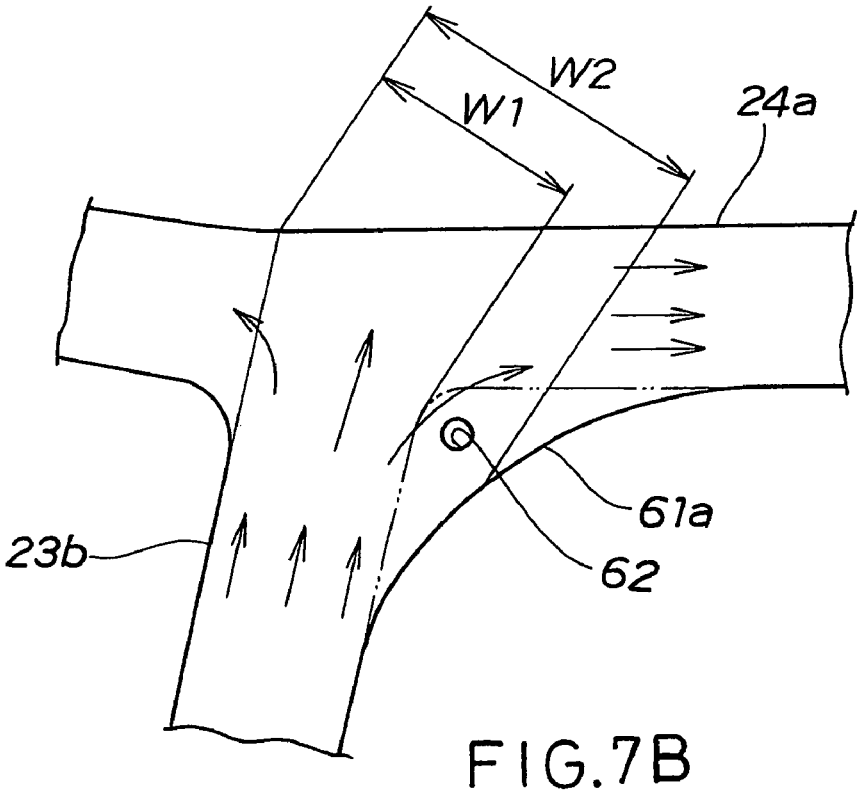
Figure 8:
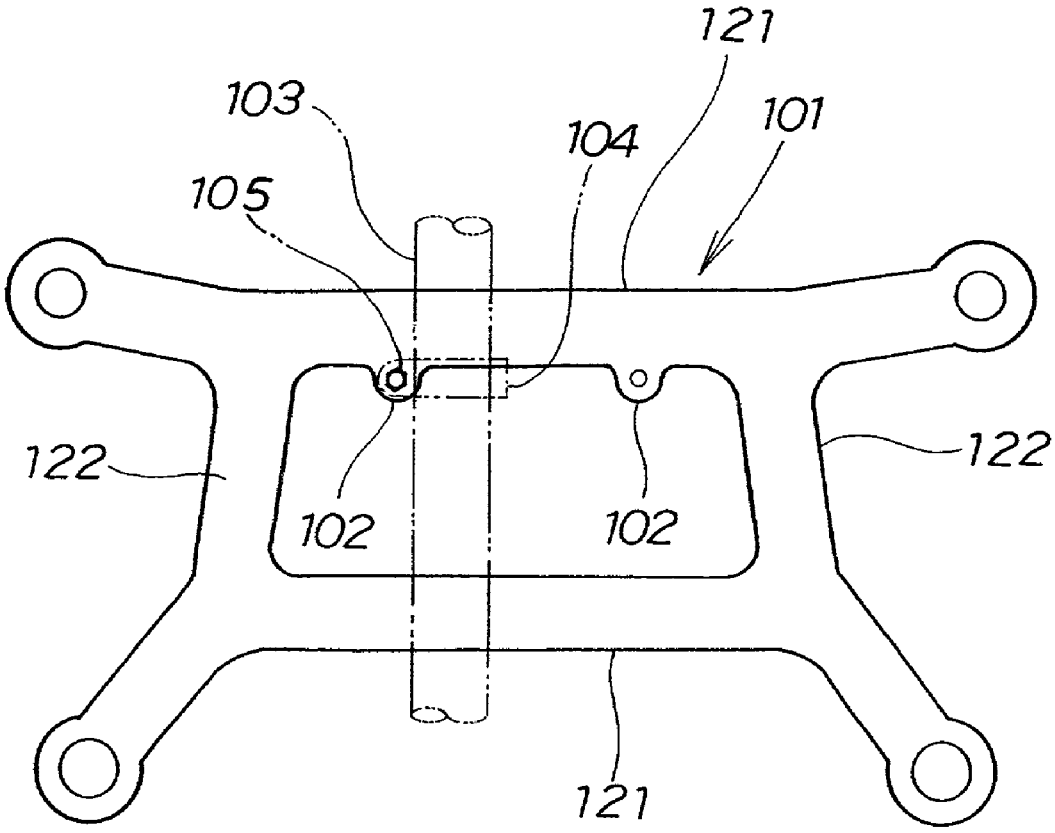
FIG. 8 (PRIOR ART)
FIG. 8 illustrates the conventional sub-frame of FIG. 7A.
Figure 9:
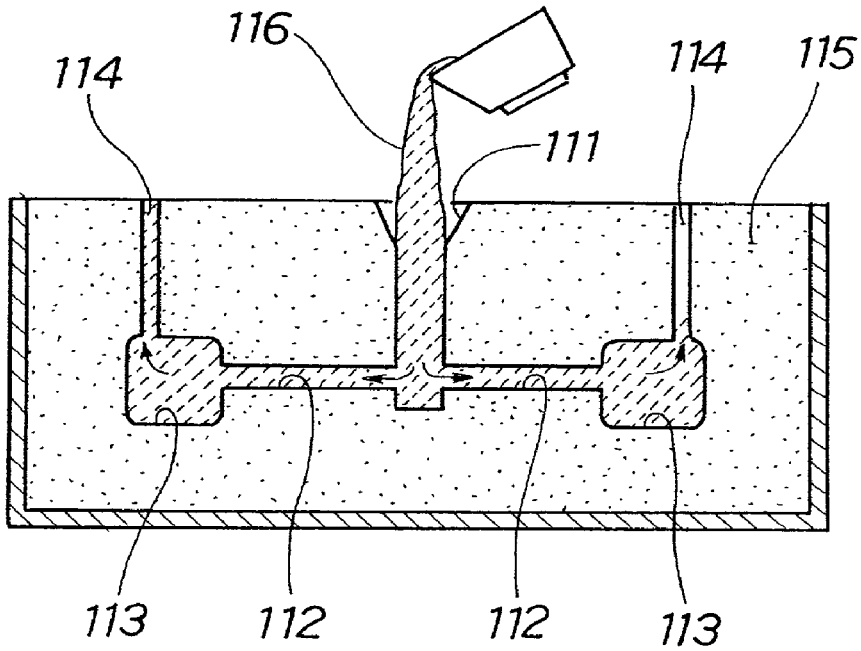
FIG.9 (PRIOR ART)
FIG. 9 illustrates how a conventional sub-frame is produced using a lost foam pattern.
Figure 10:
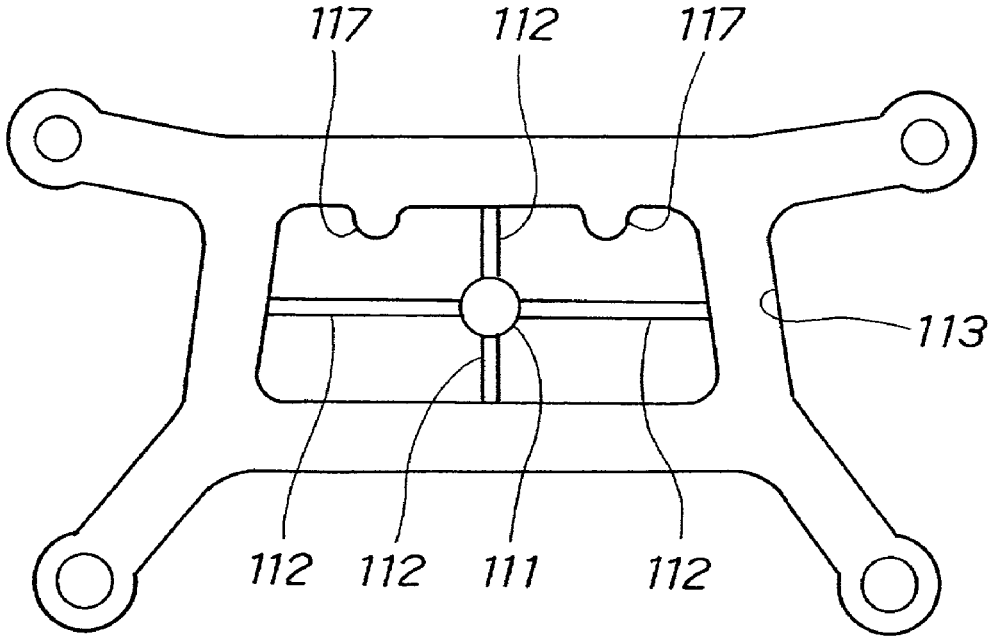
FIG.10 (PRIOR ART)
FIG. 10 illustrates a cavity formed in the lost foam pattern of FIG. 9.

As shown in FIG. 7A, the projecting portion 102 of the sub-frame 101 of FIG. 8 protrudes from the horizontal member 121. A curved portion 123 is formed at a junction portion where the horizontal member 121 and the vertical member 122 meet or are joined together. The curved portion 123 is curved to give a radius r of curvature. The radius r of curvature is made small such that the sub-frame 101 can be produced through casting using sand molds, metal molds or lost pattern molds. These molds have formed therein passageways of width W1. Molten metal filling up such passageways is cast into the junction portion of width W1.

Referring to FIG. 7B, generally triangular portions 61*a* are positioned or formed at a junction portion where the horizontal members 24*a* and 24*b* and the vertical member 23*b* meet or are joined together, respectively. The portions 61*a* are bulged towards the horizontal members 24*a* and 24*a*. Likewise, a generally triangular portions 61*b* (see FIG. 4) are positioned or formed at a junction portion where the horizontal members 24*a* and 24*b* and the vertical member 23*a* meet or are joined together, respectively. The portions 61*b* are bulged towards the horizontal members 24*a* and 24*b*. It is to be understood that these bulged portions 61*a*, 61*b* lie in a plane defined by the horizontal members 24*a*, 24*b* and the vertical members 23*a*, 23*b*. The junction portions having the thus arranged bulged portions 61*a*, 61*b* provide increased width W2. The junction portions correspond to a portion of width W2 of the cavity formed in the die casting machine 30. Each of the bulged portions 61*a*, 62*a* is pierced to provide a hole 62. Each of the bulged portions 61*a*, 62*a* having the holes 62, 62 formed therein is to be mounted to such a small vehicle component as the exhaust pipe 103 shown in FIG. 8.

It is noted that molten metal flows much faster in the die casting than in the casting. Since the junction portions have the width W2 larger than the width W1, the molten metal to be die cast flows smoothly within the portion of the cavity corresponding to the junction portion. The flow of the molten metal is shown by arrows of FIG. 7B.

By thus providing the increased width of the junction portion of the sub-frame, it becomes possible to prevent the misrun which would be otherwise produced in the die casting. Further, since there can be formed the bulges portions 61*a*, 61*b*, there is no need for particular projecting portions as shown in FIG. 8.

The term "small vehicle component" as used herein is intended to include not only the exhaust pipe but also a wide variety of components suitable for attachment to the rear sub-frame.

Although the present invention has been described as being applied to the rear sub-frame, it is applicable to a front sub-frame.

The present disclosure relates to the subject matter of Japanese Patent Applications Nos. 2000-334625 and 2000-334633, filed on Nov. 1, 2000, the disclosures of which are expressly incorporated herein by reference in their entireties.

What is claimed is:

1. A die cast sub-frame for use in mounting a vehicle component to a vehicle body, the sub-frame comprising:

a body portion; and a mounting portion adapted to be attached to the vehicle component, the mounting portion being provided on the body portion;

the sub-frame being produced by a die casting process and a die casting machine having formed therein a gate, runners communicating with the gate, and a cavity communicating with a communication portion of the runner, the die casting process comprising the steps of:

positioning the mounting portion in correspondence with the communication portion;

flowing molten alloy through the runner into the cavity, wherein solidification occurs at the farthest portion of the alloy from the communication portion;

applying pressure to the nearest part of the alloy to the communication portion, thereby compressing the nearest part into a dense cast structure having greater mechanical strength than the rest of the die cast sub-frame.

* * * * *